US006883696B1

(12) United States Patent
Steinbrunner et al.

(10) Patent No.: US 6,883,696 B1
(45) Date of Patent: Apr. 26, 2005

(54) DEPTH ADJUSTMENT MECHANISM

(75) Inventors: Glen V. Steinbrunner, Forest Hill, MD (US); Todd A. Hagan, Windsor, PA (US); C. Kerwin Braddock, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/852,986

(22) Filed: May 25, 2004

(51) Int. Cl.[7] ..... B25C 1/04
(52) U.S. Cl. ..... 227/8; 227/142
(58) Field of Search ..... 227/8, 142

(56) References Cited

U.S. PATENT DOCUMENTS

| | | | | |
|---|---|---|---|---|
| 5,685,473 | A | 11/1997 | Shkolnikov et al. | 227/8 |
| 6,012,622 | A | 1/2000 | Weinger et al. | 227/8 |
| 6,024,267 | A | 2/2000 | Chen | 227/8 |
| 6,170,729 | B1 | 1/2001 | Lin | 227/8 |
| 6,186,386 | B1 | 2/2001 | Canlas et al. | 227/142 |
| 6,209,770 | B1 * | 4/2001 | Perra | 227/8 |
| 2003/0080172 | A1 | 5/2003 | Hirai | 227/142 |

FOREIGN PATENT DOCUMENTS

| | | |
|---|---|---|
| EP | 0 298 594 B1 | 3/1995 |
| EP | 0 666 146 B1 | 12/1997 |
| EP | 0 887 155 A2 | 12/1998 |
| EP | 1 236 544 A2 | 9/2002 |
| EP | 0 811 467 B1 | 3/2003 |
| WO | WO 01/10605 | 2/2001 |

* cited by examiner

*Primary Examiner*—Ramon M. Barrera
(74) *Attorney, Agent, or Firm*—Harness, Dickey & Pierce, P.L.C.

(57) ABSTRACT

A fastening tool with a housing, a nosepiece that is coupled to the housing and a contact trip that includes a lower contact trip, an upper contact trip and a depth adjustment assembly. The lower contact trip is mounted on the nosepiece for translation between an extended position and a retracted position. The upper contact trip is separate from the lower contact trip. The depth adjustment assembly includes a stem, a sleeve that is threadably coupled to the stem, and a knob. The knob is rotatably coupled to the sleeve but axially movable thereon. The stem is coupled to one of the lower contact trip and the upper contact trip and the sleeve is captured by the other one of the lower contact trip and the upper contact trip.

22 Claims, 10 Drawing Sheets

DEPTH ADJUSTMENT MECHANISM

The present invention generally relates to portable fastening tools, such as nailers and staplers, and more particularly to a depth adjustment mechanism for a portable fastening tool.

Fastening tools for installing fasteners, such as nails and staples, often time employ a depth adjustment mechanism to permit the user to vary a depth to which a fastener may be installed. This adjustment permits the user to install the fastener to a satisfactory depth in spite of various variables, including the length of the fastener, the relative hardness of the workpiece into which the fastener is to be driven, etc.

Ideally, a depth adjustment mechanism is relatively simple to operate, provides a wide range of adjustment settings and is relatively inexpensive to fabricate and install to the fastening tool. While the known adjustment mechanisms are satisfactory for their intended purpose, they are nonetheless susceptible to improvement to thereby better achieve the aforementioned goals. Accordingly, there remains a need in the art for an improved depth adjustment mechanism.

SUMMARY

In one form, the present teachings provide a fastening tool with a housing, a nosepiece that is coupled to the housing and a contact trip that includes a lower contact trip, an upper contact trip and a depth adjustment assembly. The lower contact trip is mounted on the nosepiece for translation between an extended position and a retracted position. The upper contact trip is separate from the lower contact trip. The depth adjustment assembly includes a stem, a sleeve that is threadably coupled to the stem, and a knob. The knob is rotatably coupled to the sleeve but axially movable thereon. The stem is coupled to one of the lower contact trip and the upper contact trip and the sleeve is captured by the other one of the lower contact trip and the upper contact trip.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE VARIOUS EMBODIMENTS

Figure 1:
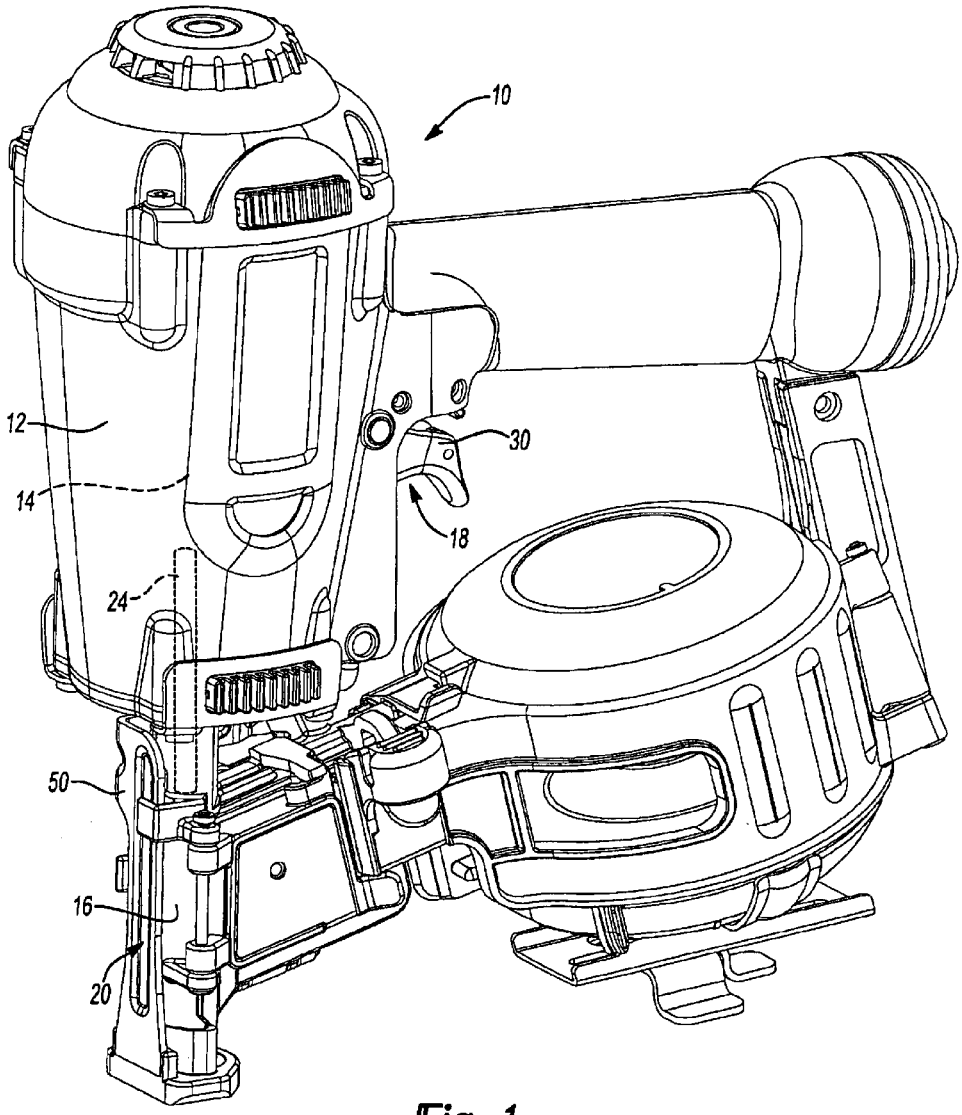
FIG. 1 is a perspective view of a fastening tool constructed in accordance with the teachings of the present invention.
Figure 2:
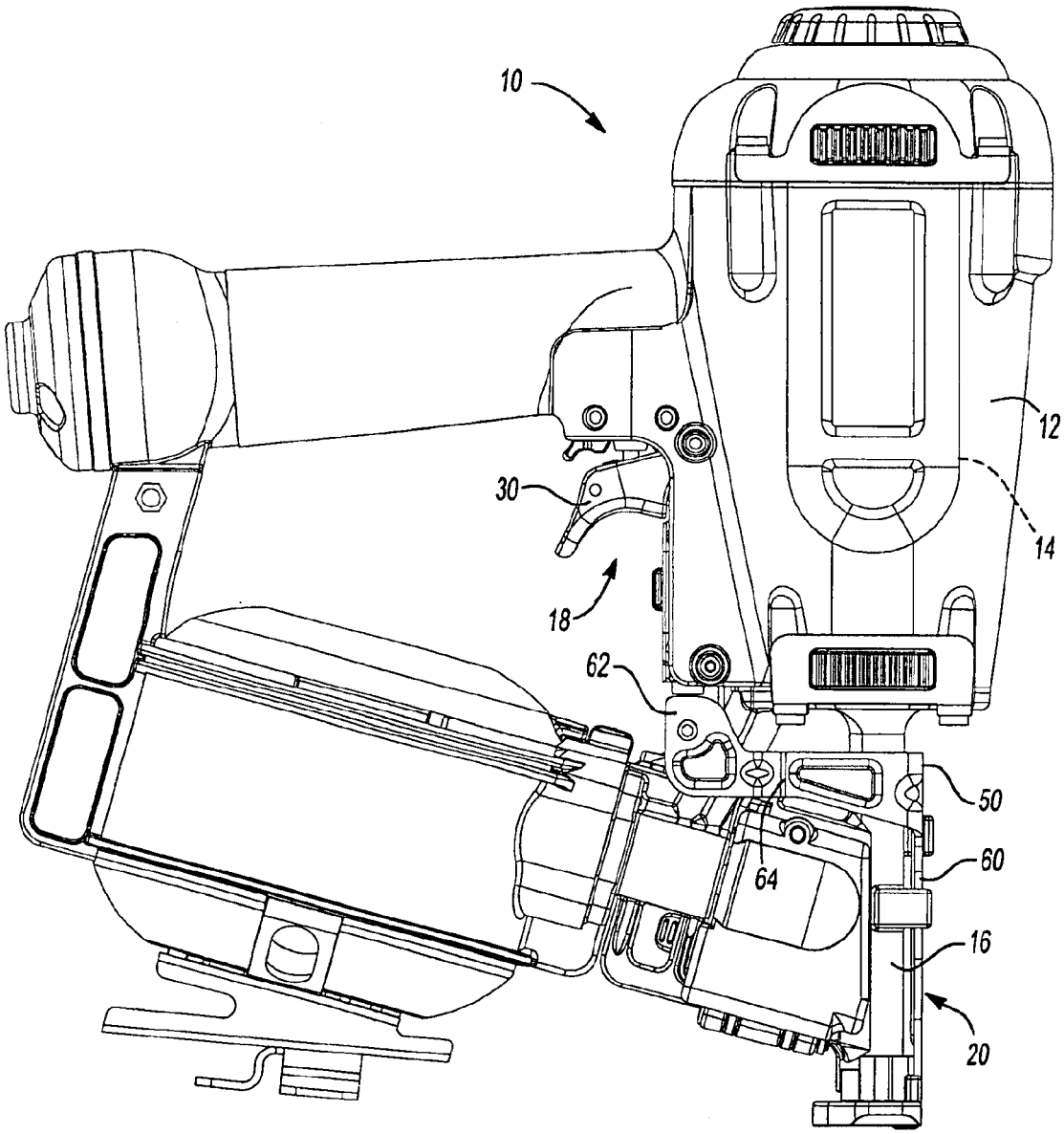
FIG. 2 is a right elevation view of a portion of the fastening tool of FIG. 1.

With reference to FIGS. 1 and 2 of the drawings, a fastening tool constructed in accordance with the teachings of the present invention is generally indicated by reference numeral 10. The fastening tool 10 may be employed to drive a fastener, such as a nail or staple, and may include a housing 12, a drive motor 14, a nosepiece 16, which may be coupled to and extend downwardly from the housing 12, a trigger assembly 18 and a contact trip mechanism 20. The drive motor 14 may be housed in the housing 12 and may include a driver 24 that may be translated to drive a fastener that is positioned in the nosepiece 16 into a workpiece. The drive motor 14 may be pneumatically operated or may employ another source of energy, such as electricity (e.g., a battery pack) or explosive (e.g., combustible, detonateable) charges, for example.

Figure 3:
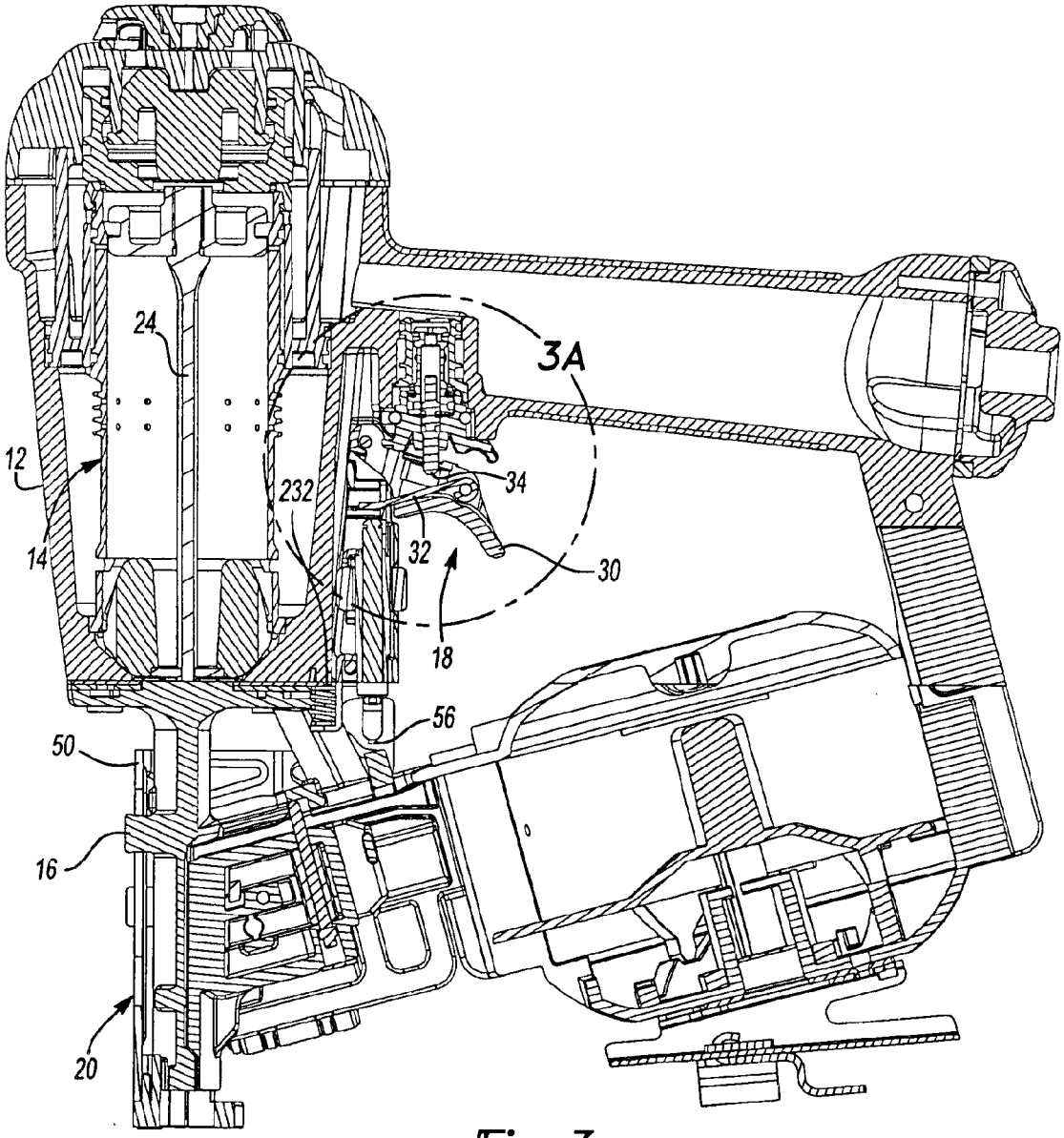
FIG. 3 is a longitudinal sectional view of the fastening tool of FIG. 1.

In FIG. 3, the trigger assembly 18 may include a trigger 30, a secondary trigger 32 and an actuator 34. The trigger 30 may be configured to receive a manual input from an operator, typically from the operator's index finger, to "arm" a first portion of the fastening tool 10. The secondary trigger 32 may be employed to "arm" a second portion of the fastening tool 10. The actuator 34 is associated with both the trigger 30 and the secondary trigger 32 and will not cause the drive motor 14 to translate the driver 24 unless both the trigger 30 and the secondary trigger 32 have "armed" their respective portions of the fastening tool 10. More specifically, movement of the trigger 30 will not, in and of itself, change the state of the actuator 34. Rather, the secondary trigger 32 must also pivot upwardly and into contact with the actuator 34 before the state of the actuator 34 is changed. In the particular example provided, the actuator 34 is a pneumatic valve, while the secondary trigger 32 is a lever that is pivotally coupled to the trigger 30. Actuation of the actuator 34 entails the opening of the pneumatic valve to permit compressed air to flow into a cylinder assembly (not specifically shown).

Those of ordinary skill in the art will appreciate, however, that the secondary trigger 32 and the actuator 34 may be configured otherwise. For example, if the fastening tool 10 were to be electrically controlled, the actuator 34 may be a controller and the secondary trigger 32 may be a switch that is coupled to the controller and which produces a signal indicative of a state (e.g., open or closed) in which the switch is positioned. In such a configuration, the trigger assembly 18 may include a trigger switch that is similarly coupled to the controller and configured to produce a signal indicative of a state in which the trigger switch (and trigger 30) is positioned. Regardless of the type of secondary switch and actuator that is employed in the fastening tool, the contact trip mechanism 20 may be employed to position the secondary trigger 32 in a position where the secondary trigger 32 has "armed" it's respective portion of the fastening tool 10.

With renewed reference to FIG. 2, the contact trip mechanism 20 may include a lower contact trip 50, a depth adjustment assembly 52, an upper contact trip 54 and a spring 56. The lower contact trip 50 may be slidably mounted on the nosepiece 16 for translation between an extended position and a retracted position. The lower contact trip 50 may include first and second arm members 60 and 62, respectively, that may be spaced apart via a leg member 64.

Figure 4:
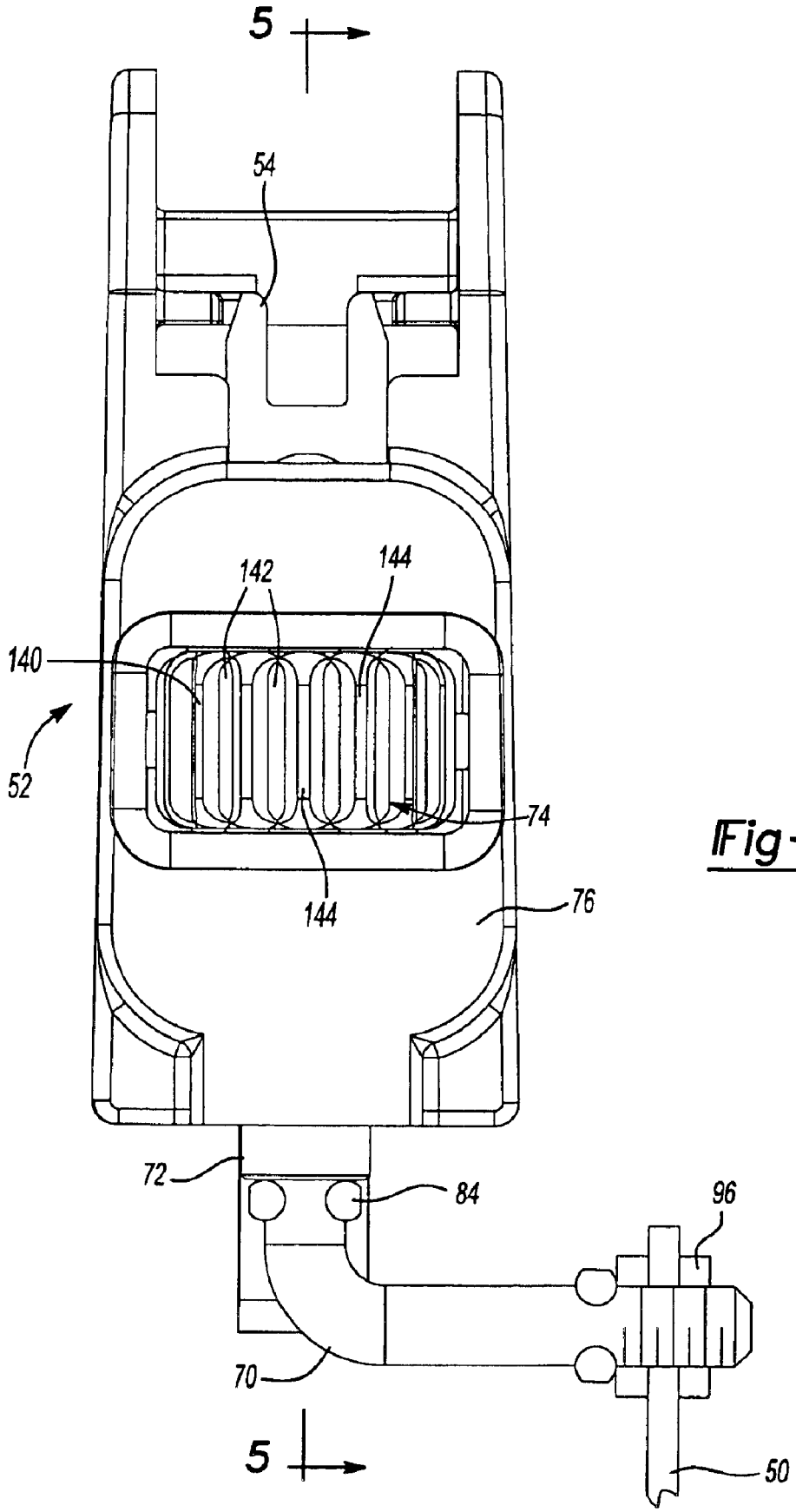
FIG. 4 is a plan view of a portion of the fastening tool of FIG. 1 illustrating the depth adjustment assembly in greater detail.
Figure 5:
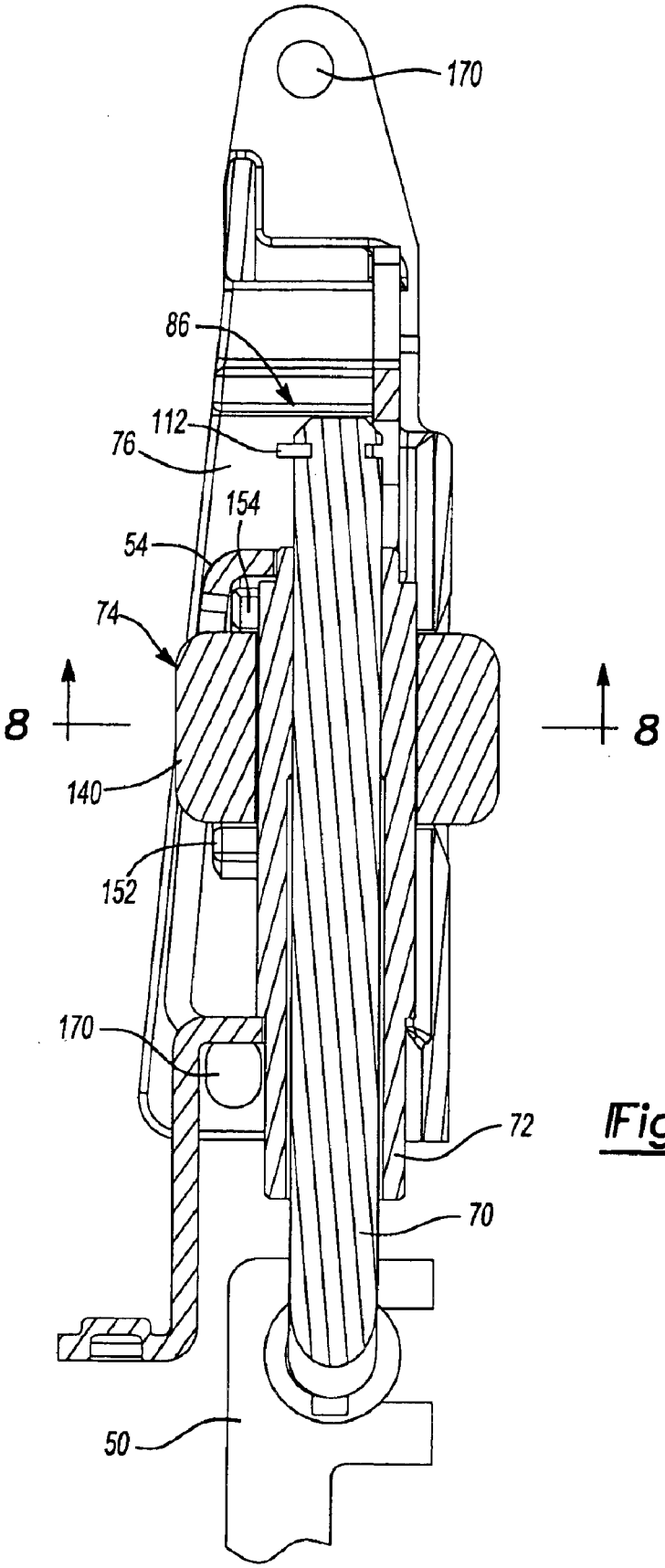
FIG. 5 is a longitudinal section view of the depth adjustment assembly taken along the line 5—5 of FIG. 4.

In FIGS. 4 and 5, the depth adjustment assembly 52 may include a stem 70, an adjusting sleeve 72, an adjusting knob 74, and an adjusting housing 76. The stem 70 may include an attachment portion 80, a threaded adjustment portion 82, an upper stop 84 and a lower stop 86. The attachment portion 80 may be coupled to the lower contact trip 50 and in the example provided, includes an end section 88 that is disposed generally transverse to the threaded adjustment portion 82. The end section 88 includes a threaded portion 90, which is configured to be received into an aperture 92, which may be open (i.e., slotted) or closed, in the lower contact trip 50, and an abutting flange 94 that is configured to abut a lateral side of the lower contact trip 50. The abutting flange 94 may include an optional washer that may be fitted over the threaded adjustment portion 82 and an abutting member against which the washer may be placed. The abutting member may be a deformity, such as a crimp, that is formed on the end section or may be an annular flange that delinates a transition between the threaded portion 90 of the end section 88 and the remainder of the end section 88. A fastener, such as a nut 96, may be employed to fixedly but removably couple the end section 88 of the attachment portion 80 and the lower contact trip 50 to one another.

Figure 6:
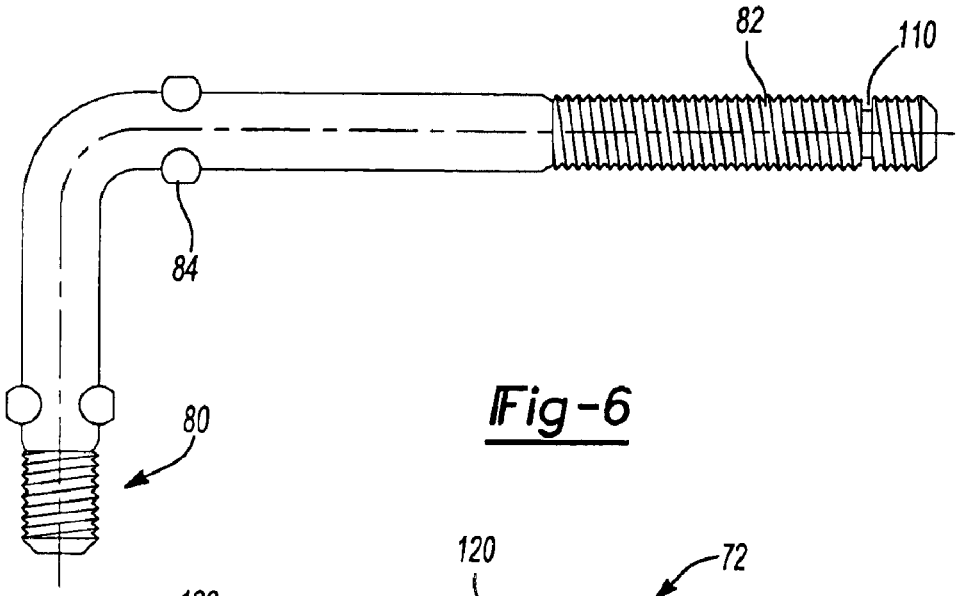
FIG. 6 is a plan view of a portion of the depth adjustment assembly illustrating the stem in greater detail.

With additional reference to FIG. 6, the threaded adjustment portion 82 may be configured to threadably engage the adjusting sleeve 72. The upper and lower stops 84 and 86 may be coupled to the threaded adjustment portion 82 and be configured to limit the amount by which the threaded adjustment portion 82 may be received into and extended from, respectively, the adjusting sleeve 72. In the particular example provided, the upper stop 84 comprises a deformity (e.g., crimp) on stem 70 that contacts the adjusting sleeve 72 to inhibit axial movement of the threaded adjustment portion 82 into the adjusting sleeve 72 beyond a predetermined upper threshold, while the lower stop 86 comprises a groove 110 that is formed on the stem 70 and a retaining ring 112 that is disposed in the groove 110 and coupled to the stem 70 to inhibit axial movement of the threaded adjustment portion 82 out of the adjusting sleeve 72 beyond a predetermined lower threshold.

Figure 7:
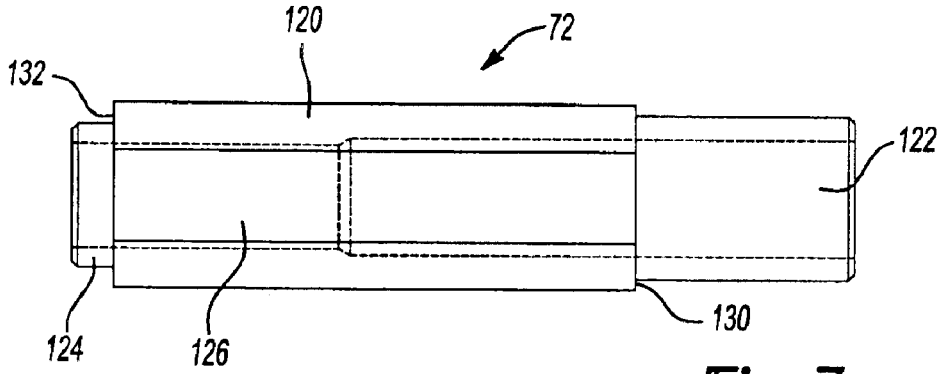
FIG. 7 is a plan view of a portion of the depth adjustment assembly illustrating the adjusting sleeve in greater detail.
Figure 8:
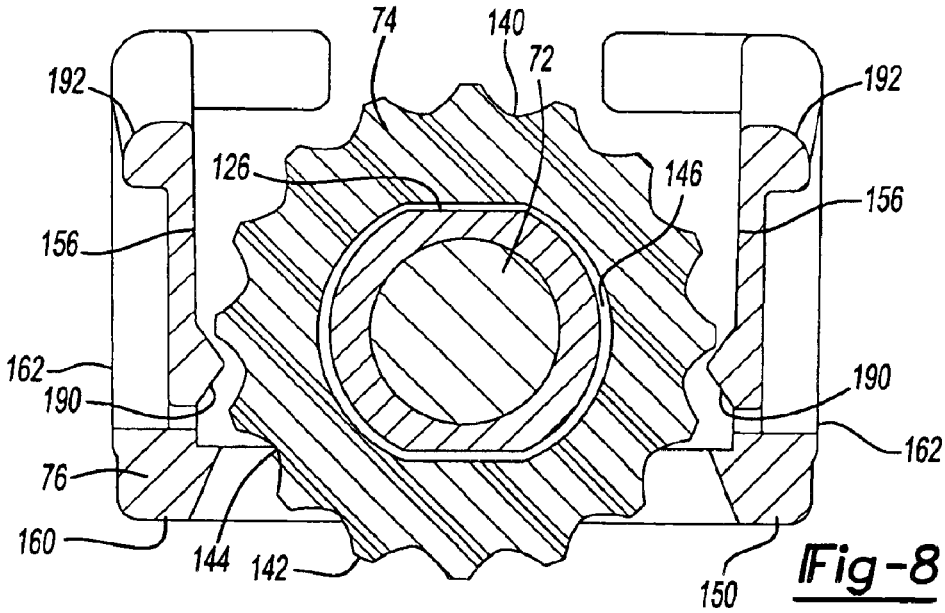
FIG. 8 is a section view taken along the line 8—8 of FIG. 5.

With reference to FIGS. 5, 7 and 8, the adjusting sleeve 72 may be internally threaded to threadably engage the threaded adjustment portion 82 and may comprise a body portion 120, a lower end section 122 and an upper end section 124. The body portion 120 may have a non-circular shape, such as a generally cylindrical shaped with one or more longitudinally extending flats 126 formed thereon. The lower and upper end sections 122 and 124 may be necked-down relative to the body portion 120 so as to define lower and upper flanges 130 and 132, respectively.

Figure 14:
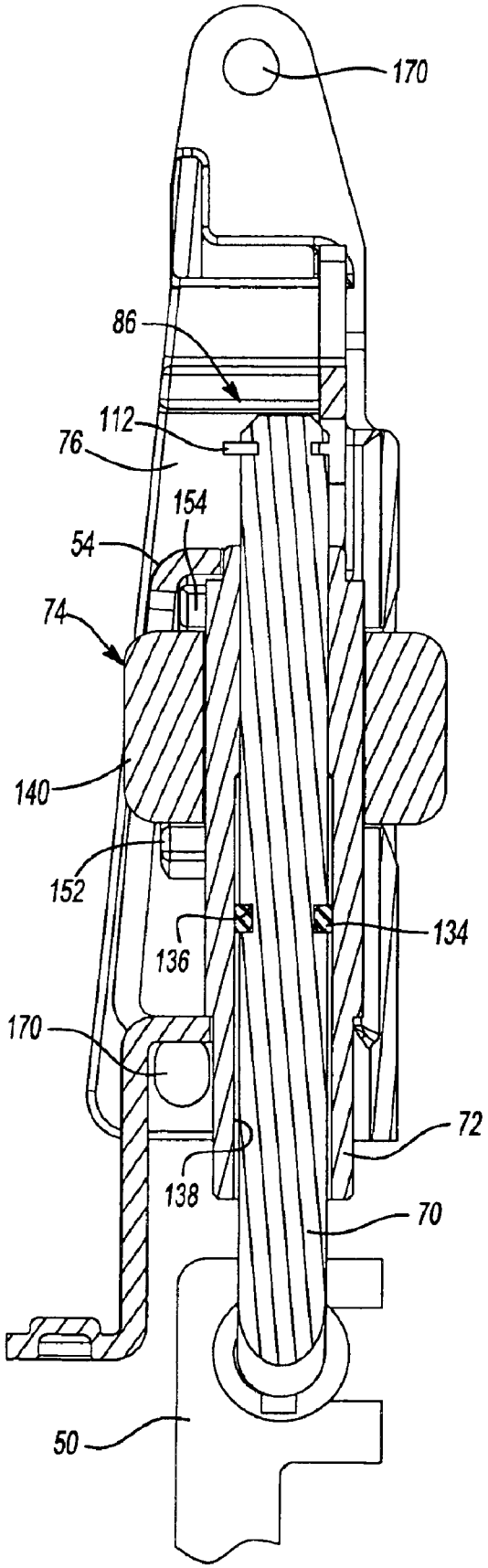
FIG. 14 is a sectional view similar to that of FIG. 5 but illustrating an alternately constructed depth adjustment assembly.

With brief reference to FIG. 14, a frictional element 134 may be coupled to one of the stem 70 and the adjusting sleeve 72 and may frictionally contact the other one of the stem 70 and the adjusting sleeve 72 so as to inhibit free rotation of the adjusting sleeve 72 relative to the stem 70. In the particular example provided, the frictional element 134 may be an elastomeric or rubber O-ring that may be fitted over the threaded adjustment portion 82 and received into a groove 136 that is formed in the stem 70. The frictional element 134 may be disposed in a cylindrically-bored section 138 that is axially spaced apart from the internally threaded portion of the adjustment sleeve 72.

Returning to FIGS. 5, 7 and 8, the adjusting knob 74 may include an outer surface 140, which may have a plurality of circumferentially alternating peaks 142 and valleys 144, and a central aperture 146. The central aperture 146 may be formed with a shape that corresponds to the non-circular shape of the body portion 120 of the adjusting sleeve 72. Configuration of the adjusting knob 74 in this manner inhibits relative rotation between the adjusting sleeve 72 and the adjusting knob 74 but permits relative axial (sliding) movement between the adjusting sleeve 72 and the adjusting knob 74 along the longitudinal axis of the body portion 120.

The adjusting housing 76 may be unitarily formed, as through injection molding, and may include a housing structure 150, first and second sets of protrusions 152 and 154, respectively, and a set of fingers 156. The housing structure 150 may have a C-channel shape with a rear wall 160, a pair of lateral side walls 162 and a brace 164 that is fixedly coupled to the side walls 162. The stem 70, the adjusting sleeve 72 and the adjusting knob 74 may be received in the channel that is defined by the rear wall 160 and side walls 162. With brief additional reference to FIG. 3, fasteners 168 may be received through apertures 170 in the side walls 162 to couple the adjusting housing 76 to the housing 12. With additional reference to FIGS. 9 and 10, one or more slots (e.g., slots 174*a* and 174*b*) may be formed in the housing structure 150, such as through the brace 164 or in the rear wall 160, to permit the upper contact trip 54 and the secondary trigger 32 (FIG. 3) to move (e.g., translate and rotate, respectively) relative to the adjusting housing 76.

Each of the first and second sets of protrusions 152 and 154 include a pair of members 180 that are coupled to an associated one of the side walls 162 and extend inwardly therefrom. An adjusting knob aperture 182 is formed in the rear wall 160 between the first and second sets of protrusions 152 and 154. The rear wall 160 and side walls 162 are configured to capture the adjusting knob 74 so that it is maintained in a predetermined position relative to the adjusting housing 76. More specifically, the adjusting knob 74 is disposed between the first and second sets of protrusions 152 and 154 and the adjusting knob 74 extends through the adjusting knob aperture 182 outwardly from the rear wall 160. Configuration of the adjusting housing 76 in this manner captures the adjusting knob 74 so as to limit axial movement of the adjusting knob 74 relative to the adjusting housing 76 but permits the adjusting knob 74 to rotate relative to the adjusting housing 76.

Figure 9:
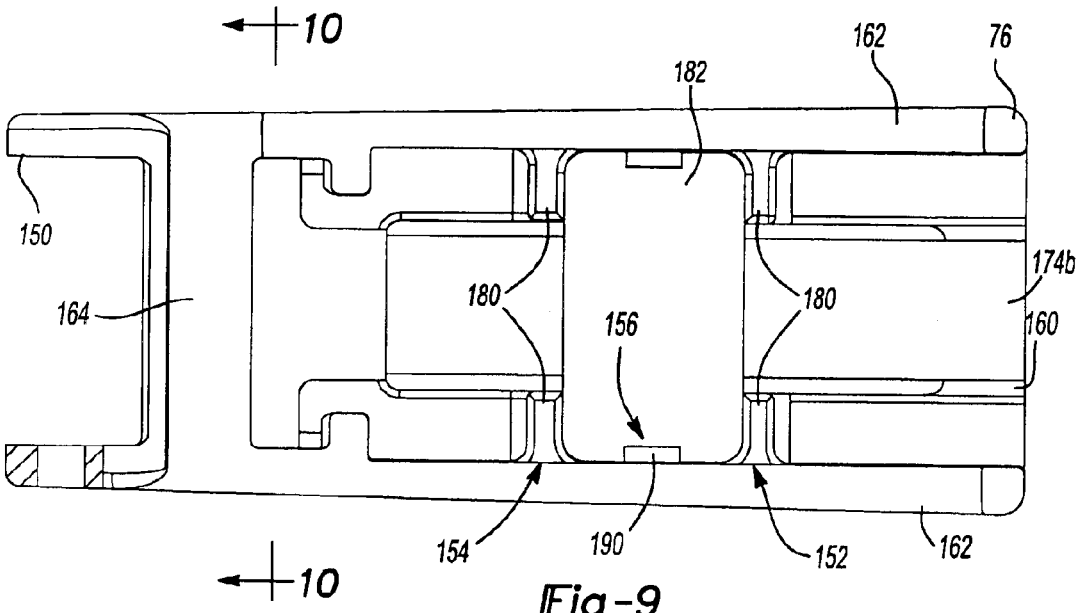
FIG. 9 is a plan view of a portion of the depth adjustment assembly illustrating the housing structure in greater detail.
Figure 10:
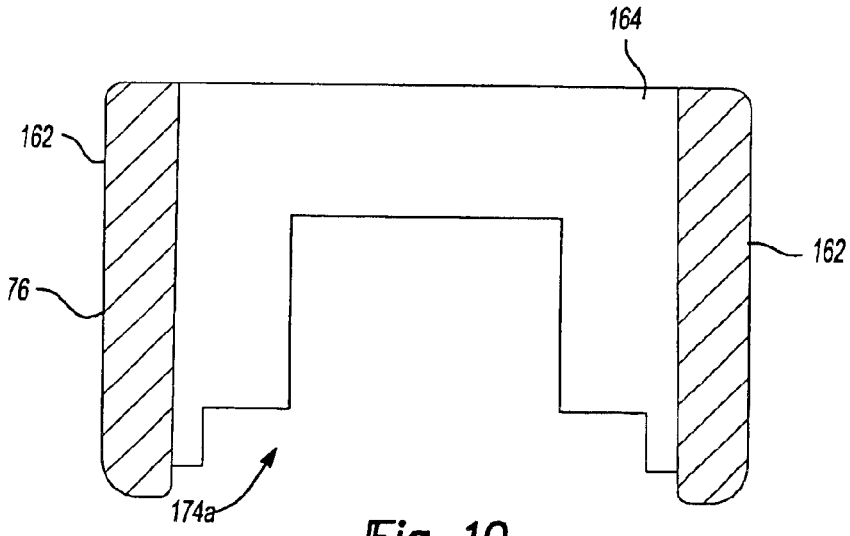
FIG. 10 is a sectional view taken along the line 10—10 of FIG. 9.

With reference to FIGS. 8 and 9, the set of fingers 156 may comprise one or more fingers 156 that may be coupled to one or both of the side walls 162 between the first and second sets of protrusions 152 and 154. Each finger 156 includes a distal end 190 which may extend inwardly toward the outer surface 140 of the adjusting knob 74, and a proximal end 192, which may be resiliently coupled to an associated one of the side walls 162 and permits the distal end 190 to be moved between a normally biased inward position and an extended position. The distal end 190, which is positioned proximate the outer surface 140 of the adjusting knob 74, may be sized so as to not contact the outer surface 140 when the distal end 190 is positioned in one of the valleys 144 but to contact the outer surface 140 when the distal end 190 is positioned against one of the peaks 142. Although interaction between the fingers 156 and the outer surface 140 of the adjusting knob 74 inhibits the free rotation of the adjusting knob 74, the resilient connection between the fingers 156 and their respective sidewall 162 permits the adjusting knob 74 to be manually rotated. In this regard, rotation of the adjusting knob 74 initiates contact between a finger 156 and one of the peaks 142 and with continued rotation, the peak 142 deflects the distal end 190 of the finger 156 outwardly so that the peak 142 may "skip over" the finger 156.

Figure 11:
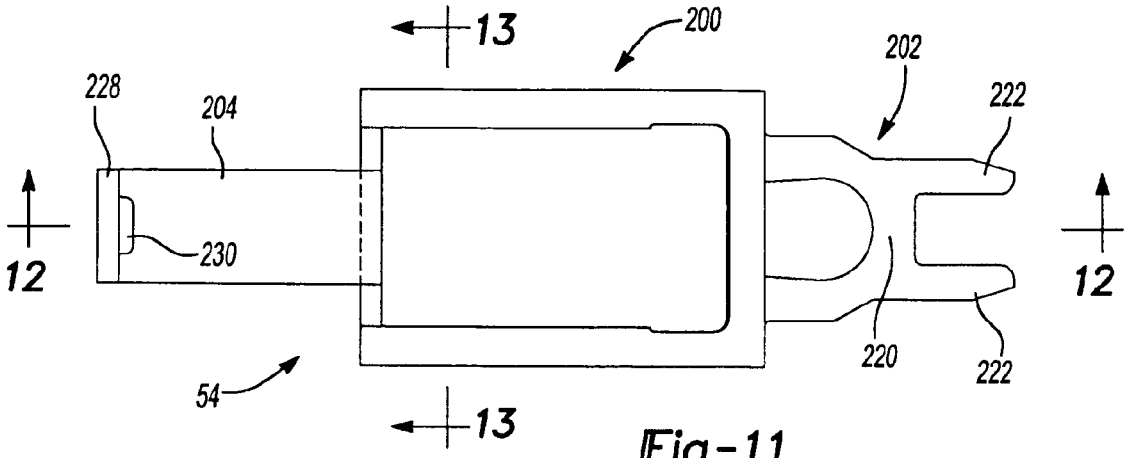
FIG. 11 is a plan view of a portion of the fastening tool of FIG. 1 illustrating the upper contact trip in greater detail.
Figure 12:
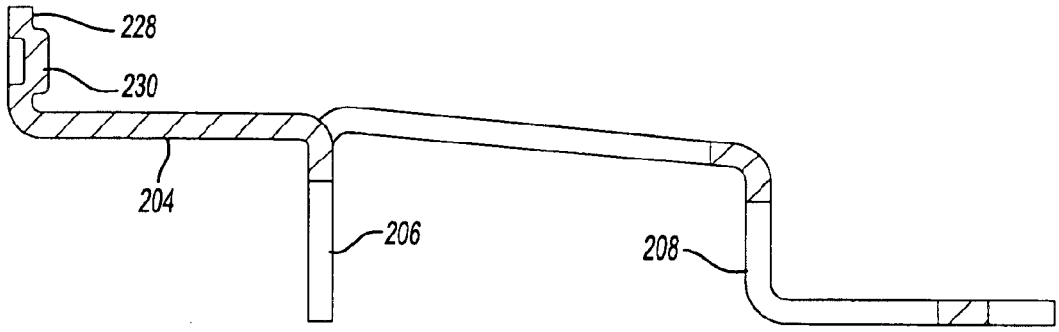
FIG. 12 is a sectional view taken along the line 12—12 of FIG. 11.
Figure 13:
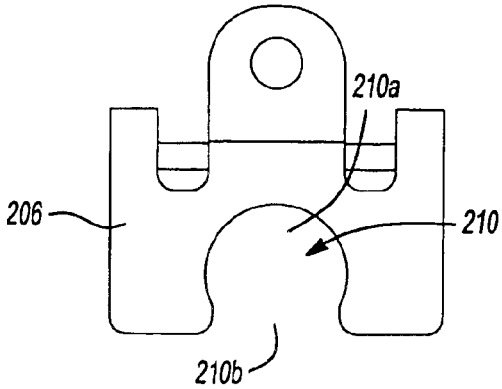
FIG. 13 is a sectional view taken along the line 13—13 of FIG. 11.

With reference to FIGS. 5, 11 and 12, the upper contact trip 54 may be unitarily formed and may include a body portion 200, a trigger contact 202 and a spring arm 204. The body portion 200 may be a cage-like structure with lower and upper end walls 206 and 208, respectively. The lower and upper end walls 206 and 208 may be spaced apart such that they are disposed on opposite sides of the body portion 120 and abut the lower and upper flanges 130 and 132, respectively. The lower and upper end walls 206 and 208 may be configured in the same manner and as such, a discussion of the lower end wall 206 will suffice for both. With additional reference to FIG. 13, the lower end wall 206 may include a slotted aperture 210 that is configured to receive the lower end section 122 of the adjusting sleeve 72, while the upper end wall 208 may similarly include a slotted aperture (not specifically shown) that is configured to receive the upper end section 124 of the adjusting sleeve 72. The slotted aperture 210 in the lower end wall 206 may include a substantially circular portion 210*a* and a necked-down portion 210*b*. The circular portion 210*a* may be sized to receive the lower end section 122 of the adjusting sleeve 72 such that the lower end section 122 may freely rotate within the circular portion 210*a* of the slotted aperture 210, while the necked-down portion 210*b* may be sized to maintain the lower end section 122 within the circular portion 210*a*. The adjusting sleeve 72 may be pressed into the upper contact trip 54 such that the lower and upper end sections 122 and 124 "snap" through the necked-down portions of the slotted apertures 210 and into the circular portions of the slotted apertures 210. In this way, the adjusting sleeve 72 may be captured by the upper contact trip 54 while being freely rotatable relative to the upper contact trip 54.

Figure 3A:
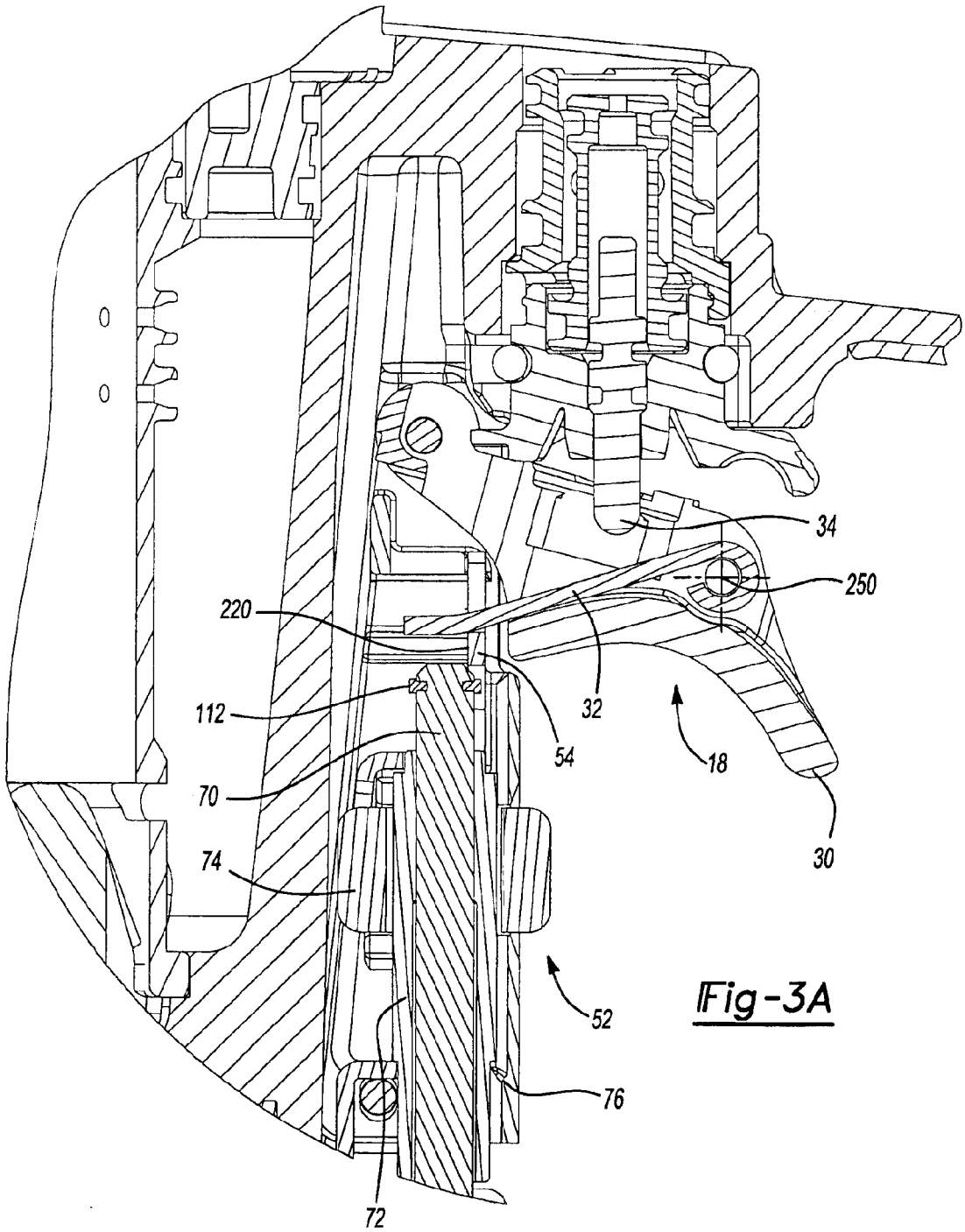
FIG. 3A is an enlarged portion of FIG. 3.

Returning to FIGS. 11 and 12 and with additional reference to FIGS. 3 and 3A the trigger contact 202 may extend upwardly from the upper end wall 208 and may be generally U-shaped, with an arm member 220 and a pair of leg members 222 that are disposed on the opposite sides of the arm member 220 so as to capture the secondary trigger 32 there between. The spring arm 204 may be coupled to the lower end wall 206 and may be generally L-shaped so as to include a spring contact 228 that extends in a forward direction.

The spring contact 228 may include a tip 230 onto which a lower end of the spring 56 may be mounted. An upper end of the spring 56, which may be a conventional compression spring, may be mounted on a post 232 that may be integrally formed with the housing 12. Accordingly, the spring 56 may be employed to bias the upper contact trip 54 outwardly away from the housing 12. Since the body portion 120 of the adjusting sleeve 72 is trapped between the lower and upper end walls 206 and 208 of the upper contact trip 54, and as the stem 70 of the depth adjustment assembly 52 is coupled to the lower contact trip 50, the depth adjustment assembly 52 and the lower contact trip 50 are likewise biased outwardly from the housing 12 by the spring 56.

Contact between a workpiece and the lower contact trip 50 may move the lower contact trip 50 upwardly toward the housing 12. As the stem 70 is coupled to the lower contact trip 50, movement of the lower contact trip 50 effects corresponding movement of the stem 70. As the stem 70 is threadably coupled to the adjusting sleeve 72 and as the adjusting sleeve 72 is captured between the lower and upper end walls 206 and 208 of the upper contact trip 54, upward movement of the stem 70 effects corresponding upward movement of the upper contact trip 54 so that the secondary trigger 32 may be moved into a position where it "arms" a respective portion of the fastening tool 10. In the example illustrated, the arm member 220 of the upper contact trip 54 contacts the secondary trigger 32 to move it about the point 250 where it is pivotably coupled to the trigger 30.

The depth to which a fastener may be installed by the fastening tool 10 may be adjusted by rotating the adjusting knob 74 to thread the threaded adjustment portion 82 of the stem 70 further into the adjusting sleeve 72 (to install the fastener relatively deeper) or further out of the adjusting sleeve 72 (to install the fastener relatively shallower).

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A fastening tool comprising:

a housing;

a nosepiece coupled to the housing; and a contact trip having a lower contact trip, an upper contact trip and a depth adjustment assembly, the lower contact trip being mounted on the nosepiece for translation between an extended position and a retracted position, the upper contact trip being separate from the lower contact trip, the depth adjustment assembly including a stem, a sleeve, and a knob, the stem being threadably coupled to the sleeve, the knob being rotatably coupled to the sleeve but axially movable thereon, wherein the stem is coupled to one of the lower contact trip and the upper contact trip and wherein the sleeve is captured by the other one of the lower contact trip and the upper contact trip.

2. The fastening tool of claim 1, wherein the depth adjustment assembly further comprises an adjustment housing, the adjustment housing being coupled to the housing and including a first set of protrusions and a second set of protrusions that cooperate to limit an amount by which the knob may translate relative to the housing.

3. The fastening tool of claim 2, wherein the adjustment housing includes at least one element that is coupled to the housing and which extends toward the knob to hold the knob.

4. The fastening tool of claim 3, wherein the at least one element is movable in response to manual rotation of the knob.

5. The fastening tool of claim 3, wherein the knob includes an outer surface with a plurality of peaks and valleys formed thereon.

6. The fastening tool of claim 5, wherein the at least one element is biased toward the outer surface of the knob and deflects outwardly therefrom in response to manual rotation of the knob.

7. The fastening tool of claim 6, wherein the at least one element is a finger that is integrally formed with the adjustment housing.

8. The fastening tool of claim 1, the other one of the lower contact trip and the upper contact trip include a pair of spaced apart end walls between which the sleeve is disposed.

9. The fastening tool of claim 8, wherein the sleeve includes at least one necked down portion that defines a flange that abuts one of the end walls, the necked down portion being received into a slotted aperture that is formed in the one of the end walls.

10. The fastening tool of claim 1, wherein the knob has a non-circular central aperture into which the sleeve is received.

11. The fastening tool of claim 1, wherein the stem includes an attachment portion that is removably coupled to the one of the lower contact trip and the upper contact trip.

12. The fastening tool of claim 11, wherein the attachment portion includes a flange and a threaded end section.

13. The fastening tool of claim 1, wherein a spring arm is coupled to one of the lower contact trip and the upper contact trip and wherein a spring is disposed between the housing and the spring arm, the spring biasing the lower contact trip into the extended position.

14. The fastening tool of claim 1, further comprising a frictional element coupled to one of the stem and the sleeve and frictionally engaging the other one of the stem and the sleeve to resist relative rotation between the stem and the sleeve.

15. The fastening tool of claim 14, wherein the frictional element is an O-ring.

16. A fastening tool comprising:

a housing;

a nosepiece coupled to the housing, the nosepiece; and a lower contact trip that is configured to translate relative to the nosepiece;

an upper contact trip that is separate from the lower contact trip; and a depth adjustment assembly for adjustably coupling the lower contact trip and the upper contact trip, the depth adjustment assembly including a stem, a sleeve, a knob and an adjustment housing, the stem having a threaded adjustment portion and an attachment portion that is removably coupled to one of the lower contact trip and the upper contact trip, the threaded adjustment portion of the stem being threadably engaged to the sleeve, the sleeve including a pair of flanges that are disposed between opposite end walls of the other one of the lower contact trip and the upper contact trip, the knob including a central aperture having a non-circular shape that corresponds to at least a portion of the sleeve to rotatably couple the knob and the sleeve but permit the sleeve to translate axially through the knob, the adjustment housing being coupled to the housing and axially capturing the knob, the adjustment housing carrying at least one deflectable member that is movable between a first position, which inhibits free rotation of the knob, and a second position, which permits the knob to be manually rotated.

17. The fastening tool of claim 16, wherein the at least one deflectable member includes a finger having a proximal end that is coupled to the adjustment housing.

18. The fastening tool of claim 17, wherein the knob includes an outer surface with a plurality of peaks and a plurality of valleys formed thereon.

19. The fastening tool of claim 18, wherein the finger does not contact the knob when a distal end of the finger is disposed in one of the valleys.

20. The fastening tool of claim 16, wherein the stem further includes first stop for limiting an amount by which the threaded adjustment portion may be threaded into the sleeve and a second stop for limiting an amount by which the threaded adjustment portion may be threaded out of the sleeve.

21. The fastening tool of claim 20, wherein at least one of the first and second stops is integrally formed with the stem.

22. The fastening tool of claim 16, wherein the stem is generally, L-shaped.

* * * * *

UNITED STATES PATENT AND TRADEMARK OFFICE

CERTIFICATE OF CORRECTION

PATENT NO. : 6,883,696 B1
APPLICATION NO. : 10/852986
DATED : April 26, 2005
INVENTOR(S) : Glen V. Steinbrunner et al.

It is certified that error appears in the above-identified patent and that said Letters Patent is hereby corrected as shown below:

Column 7,
Line 27, after "housing," delete "the nosepiece".

Signed and Sealed this

Fourth Day of September, 2007

JON W. DUDAS
*Director of the United States Patent and Trademark Office*